US005845698A

United States Patent [19]

Kim

[11] Patent Number: 5,845,698

[45] Date of Patent: Dec. 8, 1998

[54] MANUFACTURING METHOD OF ALUMINUM ALLOY HAVING HIGH WATER RESISTANCE

[75] Inventor: Jun-Su Kim, Seoul, Rep. of Korea

[73] Assignee: Hyundai Motor Company, Seoul, Rep. of Korea

[21] Appl. No.: 558,262

[22] Filed: Nov. 13, 1995

[30] Foreign Application Priority Data

Dec. 5, 1994 [KR] Rep. of Korea ..... 1994 32779

[51] Int. Cl.[6] ..... B22D 19/08; B22D 18/02

[52] U.S. Cl. ..... 164/97; 164/100; 164/120

[58] Field of Search ..... 164/97, 58.1, 34, 164/120, 100

[56] References Cited

U.S. PATENT DOCUMENTS

| | | | |
|---|---|---|---|
| 4,034,464 | 7/1977 | Hetke | 164/97 |
| 4,587,707 | 5/1986 | Nishida et al. | 164/58.1 |
| 4,899,800 | 2/1990 | Gallerneanlt et al. | 164/58.1 |
| 4,934,442 | 6/1990 | Futamara et al. | 164/120 |
| 5,394,930 | 3/1995 | Kennerknecht | 164/34 |
| 5,588,477 | 12/1996 | Sokol et al. | 164/34 |

FOREIGN PATENT DOCUMENTS

| | | |
|---|---|---|
| 2-8823 | 2/1990 | Japan . |

*Primary Examiner*—Patrick Ryan
*Assistant Examiner*—I. H. Lin
*Attorney, Agent, or Firm*—Finnegan, Henderson, Farabow, Garrett & Dunner, LLP

[57] ABSTRACT

The present invention relates to a manufacturing method of aluminum alloy having high wear resistance, in particular, to manufacturing method of aluminum alloy by dispersing silicon particle on only required part of wear resistance, and infiltrating the molten metal into the preform of silicon particle.

1 Claim, No Drawings

MANUFACTURING METHOD OF ALUMINUM ALLOY HAVING HIGH WATER RESISTANCE

FIELD OF THE INVENTION

The present invention relates to a manufacturing method of aluminum alloy having high wear resistance. In particular, the invention relates to a manufacturing method of aluminum alloy by manufacturing a preform containing dispersed silicon particles inserting the preform in a metal mold defining a part requiring wear resistance, and infiltrating the molten metal into the preform containing dispersed silicon particles.

DESCRIPTION OF THE RELATED ART

Cast iron has been generally used a material for cylinder blocks. But to achieve high lightness and efficiency in a engine, aluminum alloy is used very often recently. The typical manufacturing methods of aluminum cylinder block are as follows;

First, a method by using aluminum-silicon alloy having excellent casting property as material of major part of cylinder block and inserting the known cylinder liner made of cast iron into cylinder inner wall (active part), because high wear resistance and corrosion resistant ability is required at the active part, Secondly, an increasing method of wear resistance of cylinder inner wall by plating the active part of cylinder bore with the material which ceramic particle is dispersed at nickel or nickel-phosphorous as base, or post-treating of plating with hardening chromium, Thirdly, a method by treating the inner wall of cylinder block as surface with high wear resistance by using silicon-aluminum hyper eutectic alloy having 6 to 20 wt % of silicon content, Fourthly, an increasing method of wear resistance by using ceramic of $Al_2O_3$ short fiber etc. as dispersed composite material.

But, the first method of aluminum alloying the remainder part except liner part of the known cast iron has a physical problem at coefficient of heat transfer and heat expansion of the known cast iron, and can not be more maximized the effect of weight decrease than other methods. Especially, this method has a problem which thermal radiation and excess abrasion of piston as opposite material is not improved, and in case of producing or working, wearing-off is produced between liner of cast iron and aluminum block.

And because of heavy solidifying shrinkage of silicon-aluminum hyper eutectic alloy, the third method has many problem for casting, and because type and distribution status of super-fine silicon particle according to cooling speed is not uniformed, the wear resistance and mechanical property of cylinder block is non-uniformed greatly.

And to improve the wear resistance of liner part, because the whole block is composed of eutectic structure as weak status, its cutting workability is worsened.

And for composite material dispersing-inforced by $Al_2O_3$ ceramic fiber, because of high cost of said ceramic fiber, the manufacturing cost of cylinder block is high, therefore, has a problem for its recycling. And the ceramic fiber is covalent and ion bond compound, therefore, its physical and chemical property is different from metal matrix, when it is used as liner material loaded by heat, because of internal heat stress and interfacial reaction, many problem for mechanical property happen.

Therefore, the inventor of this invention made an effort to solve the problems of the above prior methods. As the result, by dispersing silicon particles at high density on the required part of wear resistance for inner wall of cylinder block made of silicon-aluminum hyper eutectic alloy, this invention is completed.

The object of this invention is to provide a manufacturing method of aluminum alloy having high wear resistance by dispersing silicon particles on the required part of wear resistance such as inner wall of cylinder.

SUMMARY OF THE INVENTION

The present invention relates to a manufacturing method of aluminum alloy having high wear resistance, which comprises manufacturing a preform containing dispersed silicon particles, placing the preform at a location requiring wear resistance, and then infiltrating aluminum alloy molten into the preform with 30~200 MPa pressure.

DETAILED DESCRIPTION OF THE INVENTION

This invention relates to a manufacturing method of aluminum alloy having high wear resistance by dispersing silicon particles on the part requiring wear resistance to improve a weak point of the known silicon-aluminum hyper eutectic alloy.

First, in this invention, silicon particles of 5 to 90 $\mu$m of diameter size are dispersed uniformly at high density of 12 to 54% of volume fraction ($V_f$) on inner wall of cylinder, which requires resistance, and aluminum-silicon-magnesium alloy is used as material of the remainder of cylinder block. Wherein, the diameter size of silicon particle is more than 90 $\mu$m, it is a problem for mechanical property such as tensile strength, and if the size is less than 5 $\mu$m, a problem for manufacturing of the preform arises in that molten alloy cannot penetrate. And, when $V_f$ of silicon particle is less than 12%, manufacturing of the preform becomes problematic while if the $V_f$ is more than 54%, infiltration of molten alloy becomes problematic.

To disperse the above silicon particle, preform of a liner type is manufactured by using silicon particles, and then the preform is set into liner position of metal mold and infiltrated with molten aluminum alloy into inner space of preform at 30 to 200 MPa pressure. When pressure is less than 30 MPa, because the infiltration status is not stabilized, strong composite material can not be produced, and if the pressure is more than 200 MPa, the pressurizing improvement effect is not obtained and is thus noneconomical.

When the infiltrated aluminum alloy molten is solidified, silicon particle is dispersed uniformly and aluminum alloy having excellent wear resistance is produced. And because the remainder part of cylinder block except liner is composed of aluminum alloy having excellent molding capacity and cutting workability, its cutting work for cohesion with other part is more convenient than that of conventional silicon-aluminum hyper eutectic alloy.

By the manufacturing method of this invention, silicon density of inner wall of cylinder can be improved 3 times or more than that of conventional silicon-aluminum hyper eutectic alloy having 6 to 20% of silicon content, and particle size of silicon can be uniformed freely within 5 to 90 μm. Also, because silicon is dispersed only at the part requiring wear resistance, for the remainder part, aluminum or magnesium alloy can be used.

Therefore, according to this invention, aluminum alloy having more excellent cutting workability, moulding capacity and wear resistance than those of conventional hyper eutectic alloy may be manufactured. And, if ceramic fiber and particle is dispersed, whereas a problem exists in formation of interfacial reaction substance between dispersing phase and matrix alloy and recycling of material, when the dispersed silicon particle according to this invention contacts with aluminum alloy, because the interfacial face of silicon particle is dissolved or diffused partially and silicon is re-extracted on the surface of dispersed silicon particle by same method in conventional silicon-aluminum hyper eutectic alloy, silicon can be dispersed without formation of interfacial reaction substance, and by dissolving of silicon particle, its re-using as hyper eutectic alloy or aluminum alloy is possible. By having the said characteristics, the present invention is very useful for manufacturing of engine block, shaft fork, piston or Swash plate etc.

The present invention is represented by the Examples below, which are intended to be exemplary only.

EXAMPLE 1

100 g of silicon particle having 20 to 35 μm of average diameter was dispersed in 1 l of distilled water and 1 wt % of colloidal silica as inorganic binder was added.

And then 0.5 wt % of cation starch as organic binder and 0.1 wt % of polycrymin as cohesion agent were added, and pH was adjusted to 4~5 by using HCl, hereinafter was stirred at 2000 rpm for 2 minutes.

The manufactured suspension was poured into vacuum suction equipment and by vacuum suction, preform having 30×30×100 mm size as wettable status was formed and deformed. The preform as wettable status was pre-dried at 100° C. for 12 hours and hereinafter by heating at 800° C. for 1 hour the preform was manufactured. And by using metal mold for squeeze casting, molten metal was infiltrated into inner part of the above preform, and composite material was manufactured; the preform was heated at 800° C. and installed in metal mold preheated at 300° C., and AC4B aluminum alloy heated at 830° C. was infiltrated at 100 MPa pressure.

EXAMPLE 2

74 g of silicon particle having 30 to 45 μm of average diameter was dispersed in 1 l of distilled water and 1 wt % of colloidal silica as inorganic binder was added. And then 0.5 wt % of cation starch as organic binder and 0.1 wt % of polycrymin as cohesion agent were added and stirred at 2000 rpm for 2 minutes. The manufactured suspension was poured into vacuum suction equipment and by vacuum suction, preform having 30×30×100 mm size as wettable status was formed.

The preform as wettable status was pre-dried at 100° C. for 12 hours and hereinafter by heating at 800° C. for 1 hour the preform was manufactured. And by using metal mold for squeeze casting, molten metal was infiltrated into inner part of the above preform, and composite material was manufactured; the preform was heated at 800° C. and installed in metal mold preheated at 300° C., and AC4B aluminum alloy heated at 830° C. was infiltrated at 100 MPa pressure.

EXAMPLE 3

65 g of silicon particle having 30 to 45 μm of average diameter and 18 g $Al_2O_3$short fiber (SAFFIL®) were dispersed in 1 l of distilled water and 1 wt % of colloidal silica as inorganic binder was added. And then 0.5 wt % of cation starch as organic binder and 0.1 wt % of polycrymin as cohesion agent were added and stirred at 2000 rpm for 2 minutes. The manufactured suspension was poured into vacuum filtrate suction equipment and by vacuum suction, preform having 30×30×100 mm size as wettable status was formed.

The preform as wettable status was pre-dried at 100° C. for 12 hours and hereinafter by heating at 800° C. for 1 hour the preform was manufactured. If short fiber and whisker is used partially, though it is possible to make the volume of silicon powder low, and to manufacture the preform is convenient, therefore, this method is also useful. And by using metal mold for squeeze casting, molten metal was infiltrated into the preform, and composite material was manufactured; the preform was heated at 800° C. and installed in metal mold preheated at 300° C., and AC4B aluminum alloy heated at 830° C. was infiltrated at 100 MPa pressure.

COMPARATIVE EXAMPLE 1

100 g of silicon carbide particle having 20 to 30 μm of average diameter was dispersed in 1 l of distilled water and 1 wt % of colloidal silica as inorganic binder was added.

And then 0.5 wt % of cation starch as organic binder and 0.1 wt % of polycrymin as cohesion agent were added, and pH was adjusted to 4~5 by using HCl, hereinafter was stirred at 2000 rpm for 2 minutes.

The manufactured suspension was poured into vacuum suction equipment and by vacuum suction, preform having 30×30×100 mm size as wettable status was formed. The preform as wettable status was pre-dried at 100° C. for 12 hours and hereinafter by heating at 800° C. for 1 hour the preform was manufactured. And by using metal mold for squeeze casting, molten metal was infiltrated into the preform, and composite material was manufactured; the preform was heated at 800° C. and installed in metal mold preheated at 300° C., and AC4B aluminum alloy heated at 830° C. was infiltrated at 100 MPa pressure.

COMPARATIVE EXAMPLE 2

Aluminum alloy containing 18 wt % of silicon was moulded at high pressure by using squeeze casting metal mold.

The said moulding was carried out by pressurized-solidifying aluminum alloy heated to 830° C. at metal mold heated to 300° C..

COMPARATIVE EXAMPLE 3

A 390 aluminum alloy containing 22 wt % of silicon was moulded at high pressure by using molten forgeing metal mold.

The said moulding was carried out by pressurized-solidifying A 390 aluminum alloy heated to 830° C. at metal mold heated to 300° C.

EXPERIMENTAL EXAMPLE

For the aluminum alloy manufactured by Example and Comparative Example, their wear tests were carried out. The results are as the following Table. This wear test was carried out under 600N/cm$^3$ of surface strength, 1 km of friction distance and lubrication condition, and SCr 420 was used as opposite material. And heat expansion coefficient was measured under 3 mm of diameter and 40 mm of length of specimen, from room temperature to 300° C., and 5° C./min of raising temperature speed.

TABLE

| Example | Item | | | |
|---|---|---|---|---|
| | weight loss of test specimen (mg) | weight loss of opposite material (mg) | friction coefficent | heat expansion coefficient ($\times 10^6$) |
| Example 1 | 0.4 | 3.7 | 0.09 | 14.1 |
| Example 2 | 0.6 | 3.1 | 0.07 | 15.6 |
| Example 3 | 0.58 | 3.32 | 0.08 | 14.9 |
| Comparative Example 1 | 0.3 | 25.2 | 0.12 | 17.8 |

TABLE-continued

| Example | Item | | | |
|---|---|---|---|---|
| | weight loss of test specimen (mg) | weight loss of opposite material (mg) | friction coefficent | heat expansion coefficient ($\times 10^6$) |
| Comparative Example 2 | 22.6 | 1.9 | 0.09 | 19.8 |
| Comparative Example 3 | 18.1 | 2.5 | 0.08 | 18.3 |

What is claimed is:

1. A method of manufacturing aluminum alloy having high wear resistance, the method comprising manufacturing a preliminary formed body containing dispersed silicon particles, placing the preliminary formed body into a metal mold defining a part requiring wear resistance, and then infiltrating molten aluminum alloy into the preliminary formed body with 30~200 MPa pressure.

* * * * *

UNITED STATES PATENT AND TRADEMARK OFFICE

CERTIFICATE OF CORRECTION

PATENT NO. : 5,845,698
DATED : December 8, 1998
INVENTOR(S) : Jun-Su KIM

It is certified that error appears in the above-identified patent and that said Letters Patent is hereby corrected as shown below:

On the title page, item [54]: Line 2, "WATER" should read --WEAR--.

Signed and Sealed this

Sixth Day of July, 1999

*Attest:*

Q. TODD DICKINSON

*Attesting Officer*

*Acting Commissioner of Patents and Trademarks*